US006575556B1

(12) United States Patent
Eremity et al.

(10) Patent No.: US 6,575,556 B1
(45) Date of Patent: Jun. 10, 2003

(54) SELF-CLEANING PRINT HEAD FOR INK JET PRINTER

(75) Inventors: Frank Eremity, Streamwood, IL (US); Alex Levin, Glenview, IL (US); Pietro Lostumbo, Bloomingdale, IL (US); James E. Clark, Naperville, IL (US)

(73) Assignee: Marconi Data Systems Inc., Wood Dale, IL (US)

( * ) Notice: Subject to any disclaimer, the term of this patent is extended or adjusted under 35 U.S.C. 154(b) by 0 days.

(21) Appl. No.: 09/665,226

(22) Filed: Sep. 18, 2000

(51) Int. Cl.[7] ..... B41J 2/165
(52) U.S. Cl. ..... 347/28
(58) Field of Search ..... 347/28, 22, 25, 347/27, 29, 30, 84, 85; 400/701; 134/22.11, 104.1, 169 R, 184, 198; 239/112; 118/17

(56) References Cited

U.S. PATENT DOCUMENTS

| | | | | |
|---|---|---|---|---|
| 4,296,418 A | * | 10/1981 | Yamazaki et al. | 347/28 |
| 4,528,996 A | | 7/1985 | Jones | 134/104 |
| 4,862,192 A | | 8/1989 | Slomianny | 347/7 |
| 5,489,928 A | | 2/1996 | Takahashi et al. | 347/45 |
| 5,543,827 A | | 8/1996 | Vansteenkiste et al. | 347/27 |
| 5,598,197 A | | 1/1997 | Zaba | 347/75 |
| RE35,737 E | | 2/1998 | Sourlis et al. | 347/47 |
| 5,877,788 A | | 3/1999 | Haan et al. | 347/26 |
| 5,881,958 A | * | 3/1999 | Asakawa et al. | 239/589 |
| 5,980,034 A | | 11/1999 | Tsai et al. | 347/87 |
| 6,145,954 A | | 11/2000 | Moore | 347/28 |

FOREIGN PATENT DOCUMENTS

| | | | | |
|---|---|---|---|---|
| DE | 3316226 | | 1/1984 | |
| DE | 232464 | | 1/1986 | |
| EP | 0 561 406 A2 | * | 9/1993 | |
| EP | 0 908 316 A1 | | 4/1999 | |
| EP | 0 936 071 A1 | | 12/1999 | |
| GB | 2 316 364 A | | 8/1996 | |
| JP | 59 012857 A | | 1/1984 | |
| JP | 359012857 A | * | 1/1984 | 347/28 |
| JP | 61064455 | | 2/1986 | |
| JP | 4-39055 | * | 2/1992 | |
| JP | 07314703 | | 5/1995 | |
| JP | 11058771 | | 2/1999 | |
| JP | 11268297 | | 5/1999 | |
| WO | WO 94 16900 A | | 8/1994 | |
| WO | WO 96 35584 A | | 11/1996 | |

* cited by examiner

*Primary Examiner*—Shih-wen Hsieh
(74) *Attorney, Agent, or Firm*—Piper Rudnick

(57) ABSTRACT

A self-cleaning print head for an ink jet printer directs ink to a substrate to be marked. The print head has a drop generator with a body that has a front face, an ink supply conduit and at least one orifice extending through the front face. The orifice also defines a nozzle for ejecting ink droplets. A solvent supply conduit is provided for supplying solvent to the front face of the drop generator, and a drain conduit is provided for suctioning the solvent from the front face and into the drain conduit. The supply conduit and the drain conduit have openings on the front face disposed relative to each other and the orifice(s) so that the solvent released from the supply conduit moves along the front face, adjacent the orifice(s) and into the drain conduit regardless of the spatial orientation of the print head. This allows the solvent to move residue from the front face and into the drain conduit no matter the orientation of the print head.

21 Claims, 7 Drawing Sheets

FIG. 8
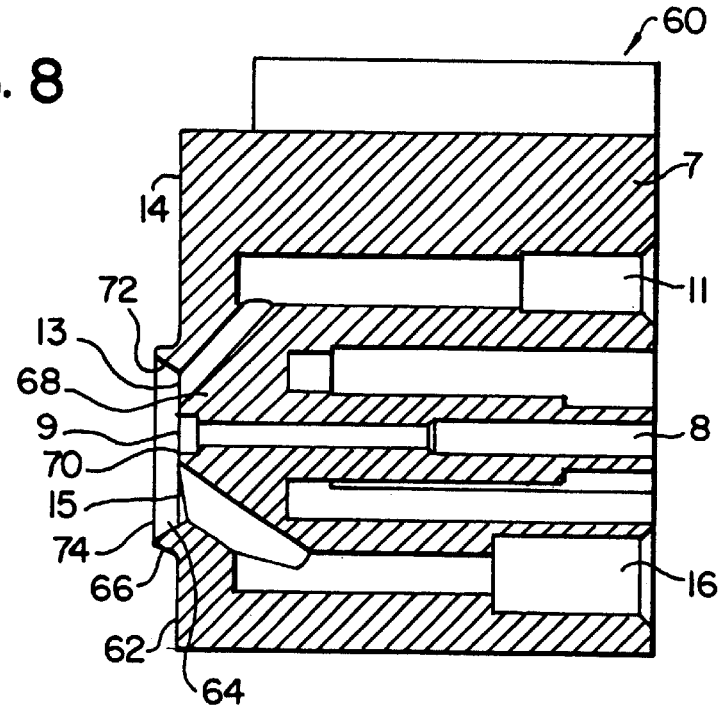
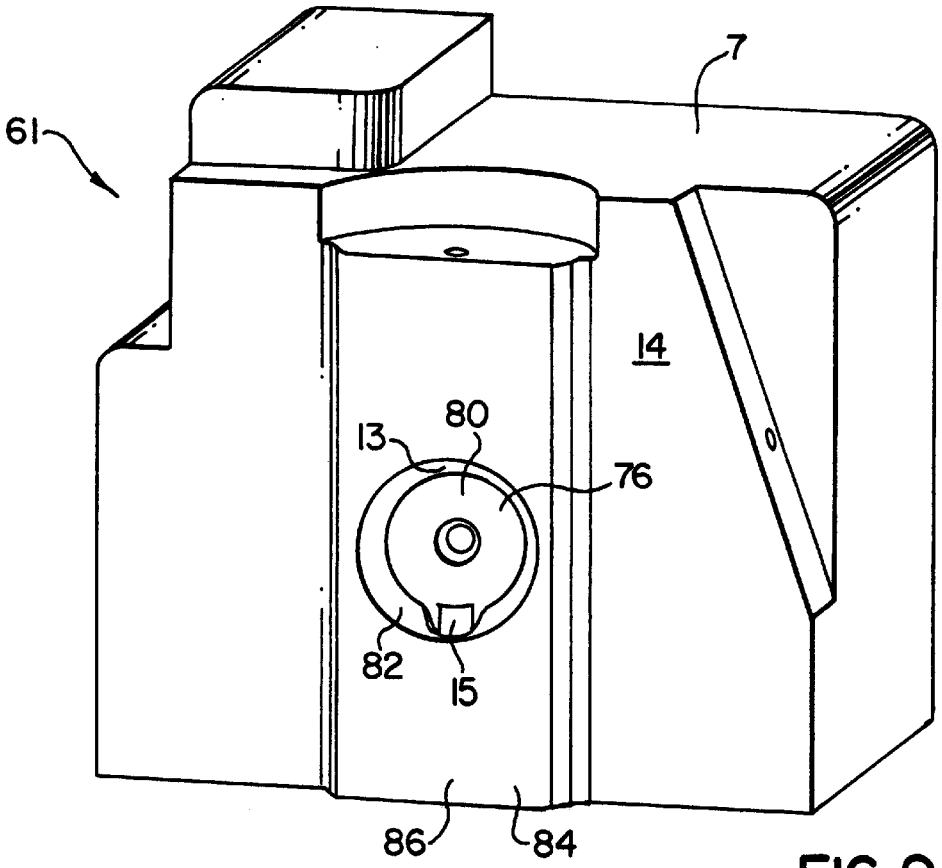
FIG. 9

SELF-CLEANING PRINT HEAD FOR INK JET PRINTER

BACKGROUND OF THE INVENTION

The present invention relates generally to a print head for an ink jet printer that projects ink for marking a substrate with the ink, and more particularly to a self-cleaning print head that automatically applies solvent to the nozzle area of the print head.

Conventional continuous ink jet printers supply electrically conductive ink under pressure to a drop generator, which has an orifice or orifices (nozzles) that are typically arranged in a linear array. The ink discharges from each orifice in the form of a filament, which subsequently breaks up into a droplet stream. Individual droplets in the stream are selectively charged in the region of the break off from the filament, and these charged drops are then deflected as desired by an electrostatic field. The deflected drops may proceed to a print receiving medium, whereas undeflected drops are caught in a gutter or catcher and recirculated.

After the printer is shut down for a period of time, ink around the orifices dries up, often partially blocking, and sometimes completely clogging, the outer openings to the orifices. Furthermore, during a long shut down period, such as an entire day or weekend, the dried ink may form a block within the orifice or passages attached to the orifice, depending on the type of ink.

Known print heads, such as that disclosed by U.S. Pat. Nos. 5,877,788 and 4,528,996, use a fluid wash that seeps over the orifices and a front face of the print head to clean away unwanted residue. This type of known print head, however, requires a certain positioning of the print head for cleaning because gravity is used to flow the cleaner along the orifices. For this reason, these types of print heads are impossible to clean in many industrial applications where omnidirectional orientation of the print head is required.

Additionally, since the solvent flows downwardly by gravity, a relatively large amount of solvent is needed to clean the front face of the known print heads because there is relatively little pressure. However, since solvent used for cleaning is recycled within the ink system, it is important that the quantity of solvent used for cleaning be low compared with the quantity of ink in the ink system. Otherwise, the ink control system may not be able to properly maintain ink composition or viscosity after orifice washing is performed.

Other conventional print heads only use a complicated mechanism that faces the front face of the nozzle to clean the outside of the orifices. Such mechanisms enclose a chamber with a shutter at the front face and flood it with cleaning fluid. However, these types of cleaning systems still typically require gravity to empty the chambers. Another type of mechanism uses a receptacle, cartridge or chamber opposing the orifices on the exterior of the drop generator for catching ink or solvent sprayed from the nozzles during a cleaning run or for suctioning ink from the nozzles. These types of mechanisms are difficult to use or are very complex, such as when the orifices are in fact in a deflection chamber behind or between ground plates and deflection plates that would have to be removed, avoided or integrated for cleaning. This type of complex system is disclosed in commonly owned U.S. patent application Ser. No. 09/162,611.

Other known print heads directed to cleaning out the inside of the orifice spray solvent or ink for cleaning through the orifice in the same direction as the ink is sprayed for printing. Another type of print head flows ink or solvent through a chamber behind the orifices in order to create suction in the orifices to pull residue into the orifices to be carried away with the solvent or to create a cross flow to prevent clogging, such as the cross flow nozzle system disclosed in U.S. Pat. No. 5,980,034. Neither of these procedures are completely effective because they do not clean the surface of the front face near the orifices where other residue can eventually collect and block the outer openings to the orifices.

Accordingly, a main object of the present invention is to provide an improved automatic self-cleaning print head that efficiently cleans the orifices and surrounding area of a print head.

More specifically, an object of the present invention is to provide an improved self-cleaning print head that cleans the front of the orifices regardless of the orientation of the print head.

Another object of the present invention is to provide an improved self-cleaning print head that effectively cleans out the inside of the orifices as well as their outer surfaces at the front face.

Yet another object of the present invention is to provide an improved self-cleaning print head that is easier to maintain due to elimination of manual work required to clean the print head.

Still another object of the present invention is to provide an improved self-cleaning print head that uses a relatively low amount of solvent for effective cleaning.

These and other objects of the present invention are discussed or will be apparent from the detailed description of the invention.

SUMMARY OF THE INVENTION

In keeping with one aspect of the present invention, a conduit supplies solvent to a front face of a drop generator near an orifice used for printing and then to a drain conduit. The drain conduit uses negative pressure to both maintain the solvent on the front face and to subsequently drain the solvent from the front face. This configuration creates a print head that can clean the front face of the drop generator regardless of the orientation of the print head, and without the aid of gravity.

More specifically, a print head for an ink jet printer that projects ink droplets to a substrate to be marked has a drop generator with a body that has a front face and at least one orifice extending through the front face. The orifice defines a nozzle for forming an ink filament and a stream of ink droplets. The print head also has a separate supply conduit for supplying solvent to the front face and a drain conduit for suctioning the solvent from the front face and into the drain conduit. Additionally, the supply conduit and the drain conduit have openings disposed relative to each other and the orifice so that the solvent released from the supply conduit moves along the front face, adjacent the orifice and into the drain conduit regardless of the spatial orientation of the print head.

In another aspect of the present invention, the print head has an extremely effective mechanism for cleaning the interior of the orifice on the front face of a drop generator as well as the main conduit that supplies the ink to the orifice for printing. This is accomplished by attaching a vacuum conduit to the main conduit just behind the orifice so that solvent located on the outside of the orifice on the front face of the drop generator is suctioned into the vacuum conduit through the orifice and the main conduit. This forces the solvent to flow completely through the orifice in the reverse direction of the ink flow through the orifice during printing.

In more detail, a print head for an ink jet printer that projects ink droplets to a substrate to be marked has a drop generator with a body that has a front face and at least one orifice extending through the front face. The orifice defines a nozzle for forming an ink filament and a stream of ink droplets. The print head also has a main conduit for supplying ink to the orifice and a supply conduit connected to a source of solvent for conveying the solvent through a supply opening and onto the front face. An orifice unclogging mechanism is also optionally supplied in the print head that forces the solvent disposed on the front face into the orifice so that the solvent flows through the orifice in the reverse direction. This structure effectively removes residue blocking an interior of the orifice with the solvent.

The present invention also includes a method of cleaning a print head for an ink jet printer. The process includes flowing solvent through a supply conduit to a front face of a body of the print head. The front face has a generally planar surface and at least one orifice extending through the front face. The orifice also defines a nozzle for forming an ink filament and a stream of ink droplets. The process further includes moving the ink along the front face adjacent the orifice, and suctioning the solvent from the front face into a drain conduit. The suctioning step removes solvent from the front face regardless of the orientation of the print head, with the solvent moving residue from the front face into the drain conduit.

BRIEF DESCRIPTION OF THE DRAWINGS

The above mentioned and other features of this invention and the manner of obtaining them will become more apparent, and the invention itself will be best understood, by reference to the following description of a preferred embodiment of the invention in conjunction with the drawings, in which:

FIG. 8 is a partial simplified cross-sectional view of the alternative drop generator shown in FIG. 7 taken along the line 8—8 in FIG. 7; and FIG. 9 is a three-dimensional perspective view of yet another alternative drop generator of the present invention.

DETAILED DESCRIPTION

Figure 1:
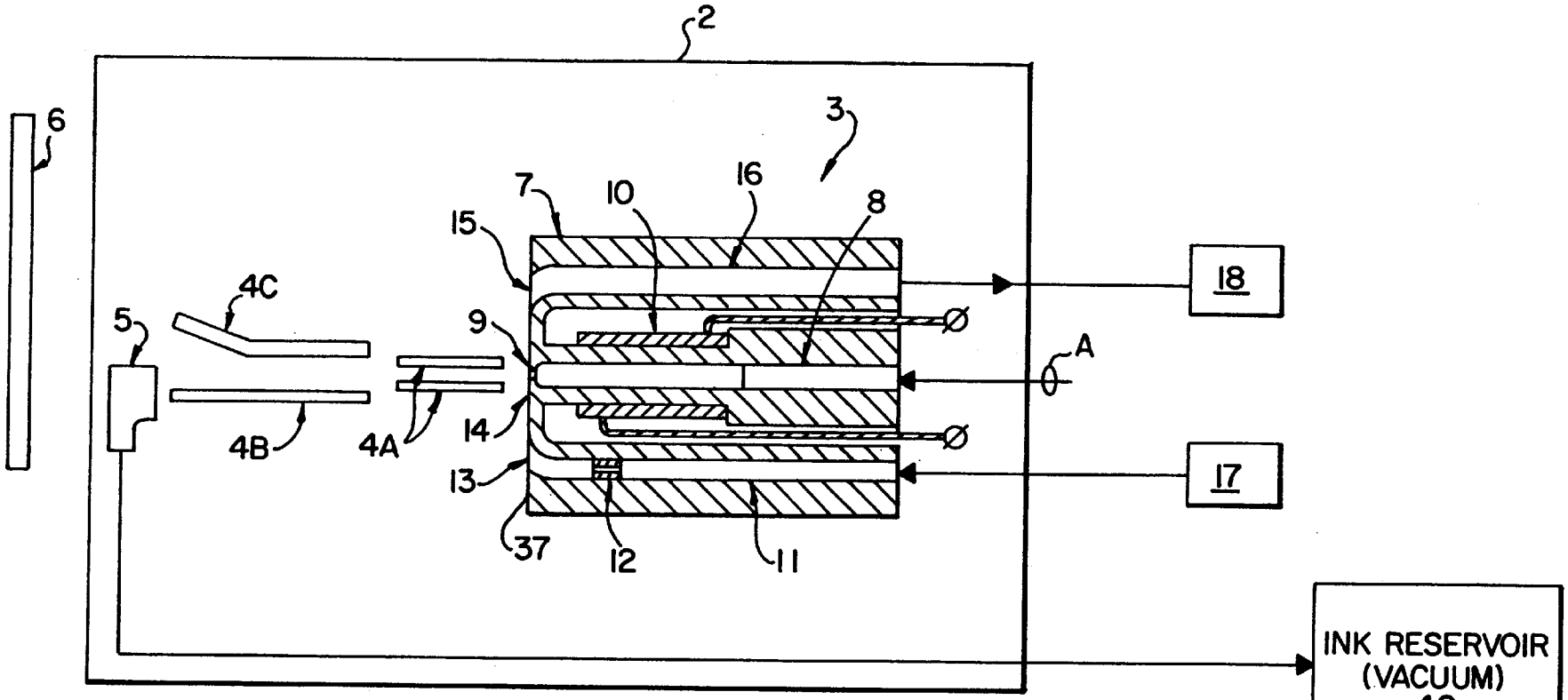
FIG. 1 is a simplified schematic side view of the components of an ink jet printer of the present invention with a drop generator shown in cross section.

The above listed objects are met or exceeded by the present self-cleaning print head for an ink jet printer, which has the following preferred configuration. Referring to FIG. 1, the ink jet printer has a print head 2 with a drop generator, generally designated 3. The drop generator 3 has an outer housing or body 7 with a front face 14. The front face 14 in this embodiment has a solvent-wettable, generally planar surface 37. The surface 37 is solvent-wettable in order to spread out the solvent to maintain the solvent as a thin film when the viscosity of the solvent is low. The solvent-wettable material can be PEEK (polyetheretherketone). For purposes of this application, a solvent-wettable surface is one on which a solvent tends to spread out, whereas a non-solvent wettable surface is one on which a solvent tends to bead up.

A charge electrode 4A, ground plate 4B and high voltage deflection plate 4C are located in front of the drop generator 3. During printing, the drop generator 3 receives ink (not shown) in a main conduit 8 flowing as shown by arrow A. A piezoelectric cylinder 10 is bonded around the main conduit 8 within the body 7 for importing vibrational energy of a selected frequency to the ink received by the drop generator 3. This causes the formation of a droplet stream which is selectively charged by electrode 4A. An electrostatic field formed between the plates 4B and 4C deflects the charged drops past a catcher 5 and onto a moving print media or substrate 6. Uncharged drops that pass through the electrode 4A and plates 4B, 4C are not deflected and pass directly into the catcher 5, which is vacuum assisted to recirculate the ink back into an ink reservoir 40.

Figure 2B:
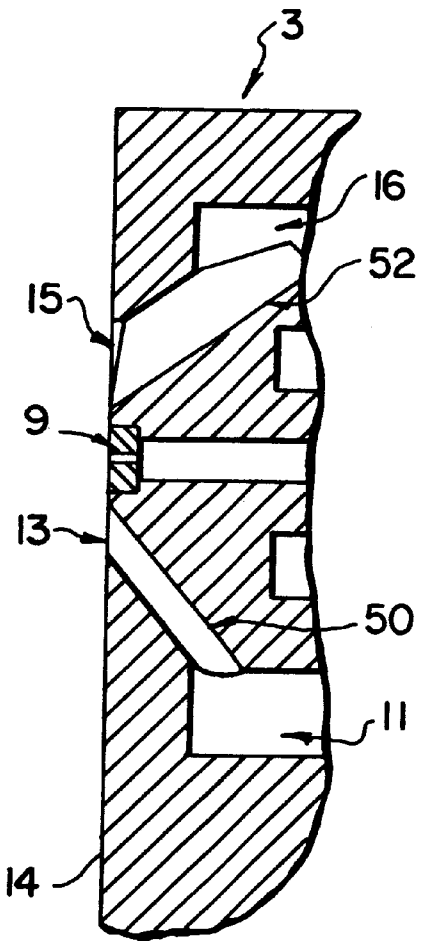
FIG. 2B is a partial cross-sectional view of another configuration for the drop generator in the ink jet printer of the present invention.
Figure 2A:
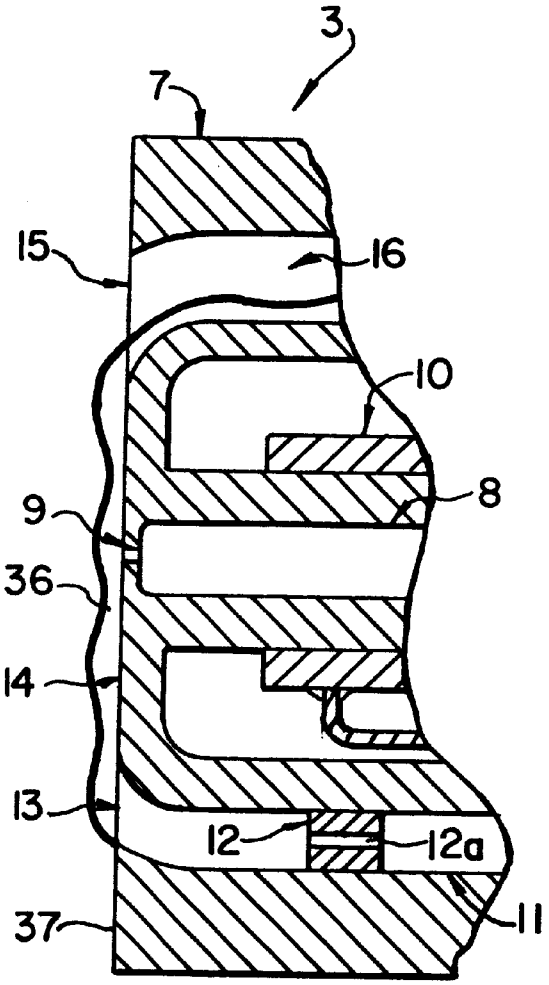
FIG. 2A is a partial cross-sectional view of one configuration for the drop generator in the ink jet printer of the present invention.

Referring to FIGS. 1 and 2A, an orifice 9 extending through the front face 14 is provided at an end of the main conduit 8 for emitting the ink stream. The drop generator 3 also has a solvent supply conduit 11 with one end terminating at a supply opening 13 on the front face 14 near the orifice 9. The opposite end of the solvent supply conduit 11 is connected to a solvent supply system 17. A flow restrictor 12 with a narrow slit or hole 12*a* is positioned within the solvent supply conduit 11 for influencing the pressurized solvent to form a thin film 36 at the supply opening 13 by reducing the pressure on the solvent as it flows from supply opening 13. By way of example, the solvent is adequately supplied at 5 ml/min under relatively low pressures (approximately 3–5 psig) and the restrictors have approximately 0.005" or 0.010" internal diameters for effective formation of a thin film of solvent. As explained previously, the solvent-wettable surface 37 is provided to sustain the thin film 36 on the front face 14.

On the opposite side of the orifice 9 from the position of the solvent supply opening 13, a drain opening 15 communicates with a drain conduit 16 connected to a solvent return system 18. Drain opening 15 is preferably larger than supply opening 13. The drain conduit 16 also is under vacuum pressure (preferably, approximately 10" mercury). The thin layer of solvent 36 flows out of the supply opening 13, over orifice 9 and into drain opening 15 as illustrated in FIG. 2A.

FIG. 2A shows a preferred configuration having curved conduit openings 13, 15, such as when the drop generator is manufactured by injection molding, for example. The preferred configuration for the solvent supply conduit 11 and drain conduit 16 when the drop generator is made by machining (or drilling) includes angled portions 50, 52 respectively (FIG. 2B). This angled or curved configuration further directs and maintains the flow of the solvent over the orifice 9 and adjacent area. In a preferred embodiment, the angled portion 50 (and, therefore, the supply opening 13) has a diameter of 0.025" slanted at an angle of 40° to the face 14. Similarly, in a preferred embodiment, the angled portion 52 (and, therefore, the drain opening 15) has a diameter of 0.050" slanted at an angle of 55° to the face 14.

Figure 3:
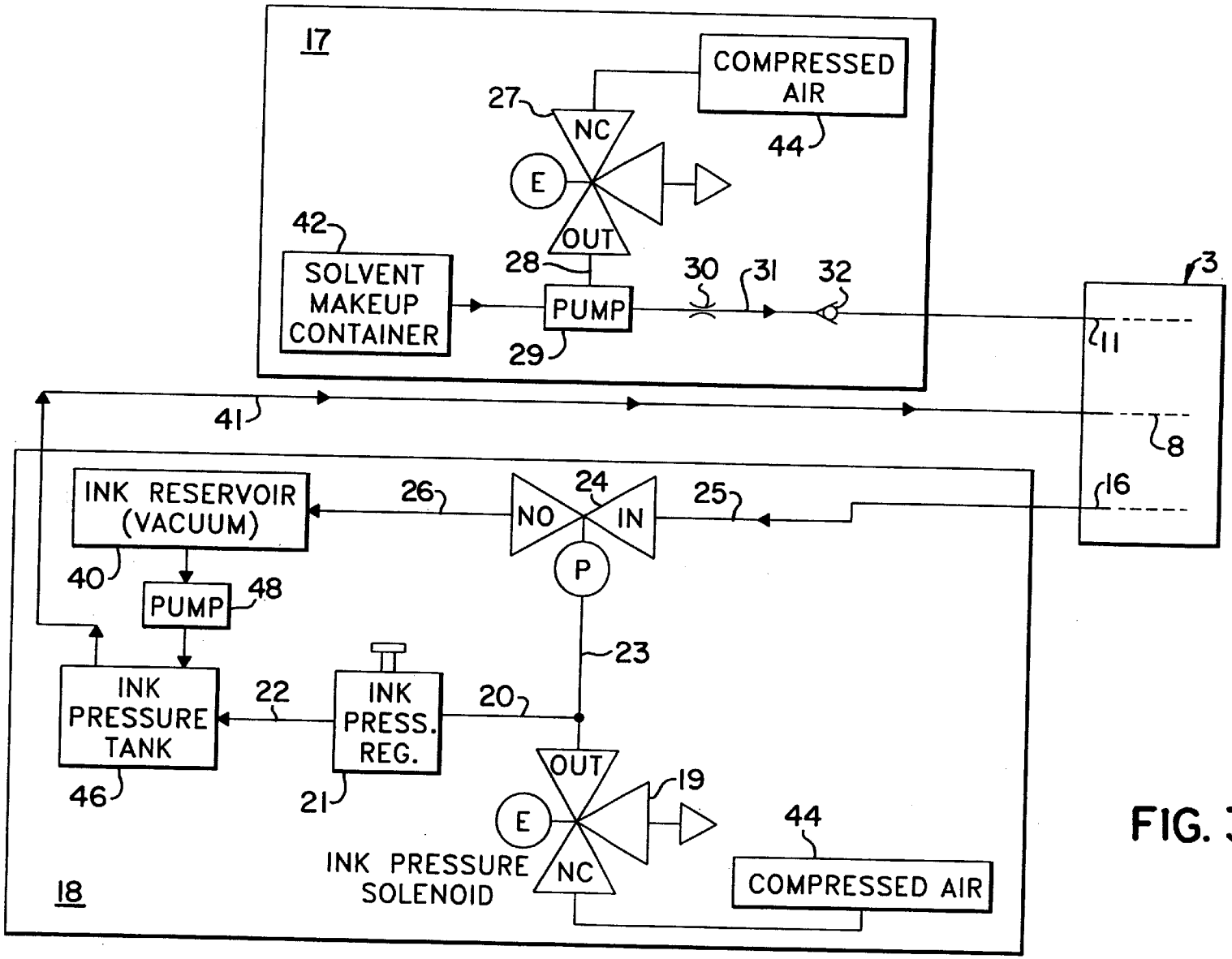
FIG. 3 is a diagram of the system for circulating the solvent in the ink jet printer of the present invention.

Referring to FIG. 3, the solvent supply system 17 provides a pump 29 that runs the cleaning solution or solvent from a solvent makeup container 42, through a conduit 31 and to the supply conduit 11 at the drop generator 3. On the conduit 31, the solvent flows through a check valve 32, and is also shown flowing through an alternative flow restrictor 30 connected in the solvent supply system 17. The alternative flow restrictor 30 can be used instead of the flow restrictor 12 disposed within the solvent supply conduit 11 in the drop generator 3. The flow restrictor 30, similar to flow restrictor 12, is provided to regulate the flow of solvent through adjustment of the solvent supply pressure. A valve 27 is also provided in the solvent supply system 17 for providing compressed air 44 through conduit 28 and to the pump 29. The pump 29 uses the compressed air 44 to force or push the ink to the print head 2. It will be appreciated, however, that other pumping systems that do not use compressed air could be used instead.

The solvent return system 18 has an ink pressure solenoid-activated valve 19 (hereafter, referred to merely as ink pressure solenoid 19) connected through conduit 20 to an ink pressure regulator 21, which in turn is connected to an ink pressure tank 46 though conduit 22. Ink pressure tank 46 is further connected to main conduit 8 through conduit 41. Solenoid 19 also connects with a valve 24 through conduit 23. In one direction, the valve 24 also connects to a conduit 25 that links to drain conduit 16 at the drop generator 3. In another direction, the valve 24 connects to a conduit 26 that opens to the ink reservoir 40.

Referring again to FIGS. 1 and 3, when the ink jet printer is running, ink is pumped from the reservoir 40 by transfer pump 48, pressurized in ink pressure tank 46 and then supplied to main conduit 8 via conduit 41 for printing. The ink is pressurized by energizing the ink pressure solenoid 19, which allows compressed air 54 into conduit 20, ink pressure regulator 21, conduit 22 and the ink pressure tank 46. Compressed air 54 in the conduit 23 closes air operated valve 24, which closes off conduit 25 from the ink reservoir vacuum conduit 26.

For the cleaning process (preferably before start-up, after shutdown or during maintenance operations), however, the ink supplied to the main conduit 8 is shut off by de-energizing the ink pressure solenoid 19 to de-pressurize the ink pressure tank 46, which turns off the ink stream. De-energizing solenoid 19 also allows valve 24 to open and connects conduit 25 to the ink reservoir 40 (under vacuum) through conduit 26. This permits used solvent and residue ink from the front face 14 of the drop generator 3 to be placed in the ink reservoir 40. As the total amount of solvent added to the ink system during cleaning is relatively small, ink composition control is substantially unaffected by the cleaning operation.

Shortly after ink pressure solenoid 19 is de-energized, valve 27 is energized. This allows compressed air 44 to flow through conduit 28 to air operated pump 29, which pumps the solvent through conduit 31 and check valve 32. Check valve 32 is of sufficient opening or cracking pressure to keep the solvent supply conduit 11 clear of low pressure liquid and to prevent reverse or back flow. From conduit 31, the solvent supply system 17 supplies solvent under pressure through solvent supply conduit 11 in the drop generator 3, flow restrictor 12 (or, alternatively, flow restrictor 30), supply opening 13 and onto front face 14. On the front face 14, the solvent spreads over an area adjacent orifice 9 in a thin film 36 as shown best in FIG. 2A. The solvent flow may be uniform, but pulsating flow is preferred. The type of solvent flow will depend on its supply pressure mechanism. For example, different pump restrictions or pump control systems can provide either uniform or pulsed fluid pressures, thus providing either uniform or pulsating solvent flow.

While the flow of solvent dissolves residue, ink accumulations or any other particles on the front face 14 and in the orifice 9, the solvent is sucked into drain opening 15 and follows drain conduit 16 back to the solvent return system 18. Appropriate negative pressure or vacuum from drain conduit 16 sustains the thin film solvent flow on the front face 14 in any print head spatial orientation, independent of gravity, and prevents solvent from dropping off the print head 2. After a predetermined cleaning time, valve 27 is de-energized to stop the flow of compressed air 44 and turn off pump 29, thereby stopping the flow of solvent.

Figure 4:
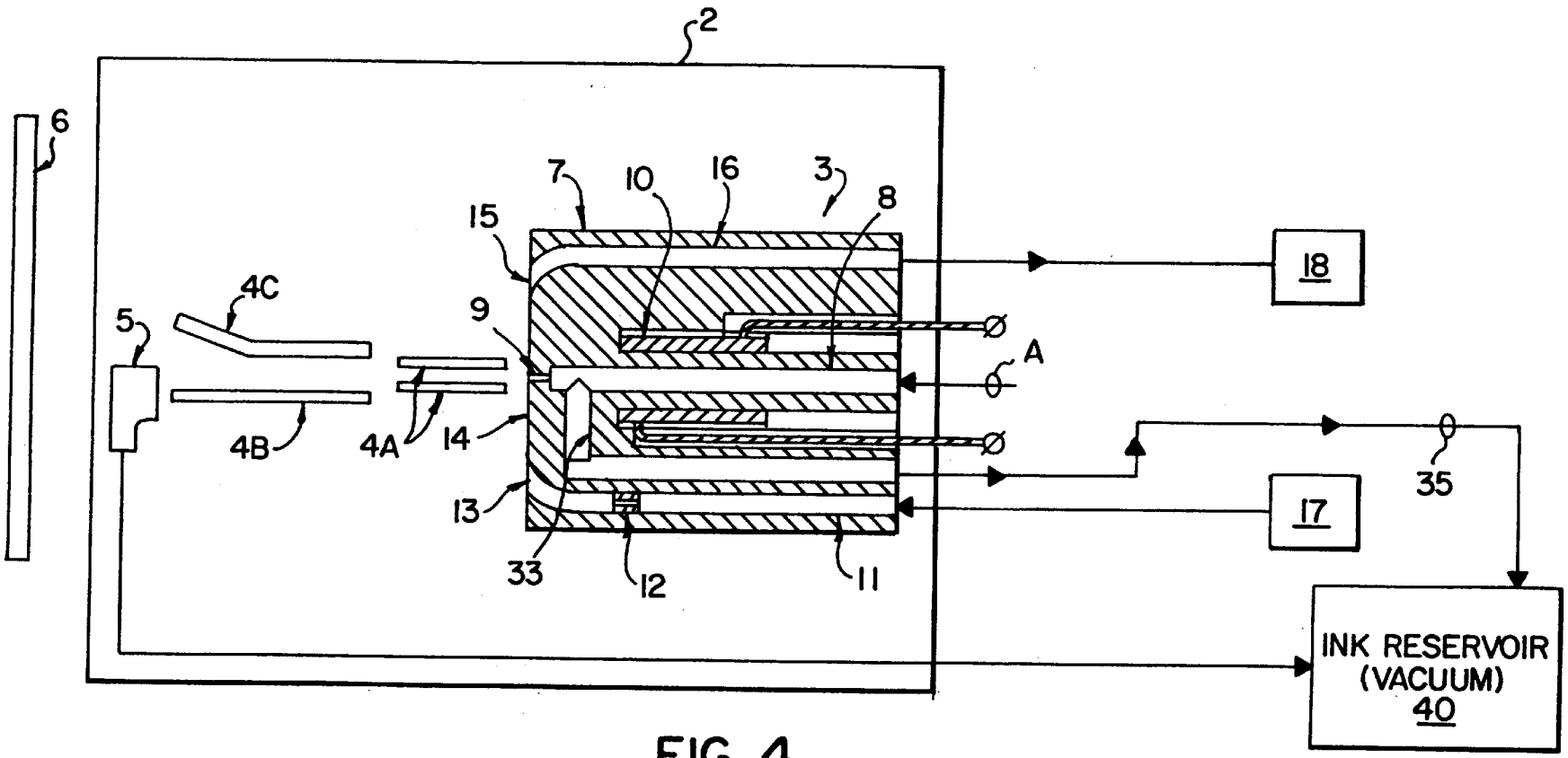
FIG. 4 is a simplified schematic side view of the components of an ink jet printer of the present invention with an alternative drop generator.

Referring now to FIG. 4, in another aspect of the preferred embodiment, the drop generator 3 is also provided with a vacuum conduit 33 that is connected at one end to the main conduit 8 just behind the orifice 9. The other end of the vacuum conduit 33 is connected via conduit 35 to the ink reservoir 40 under vacuum. During the cleaning process, when conduit 33 is applying negative pressure or vacuum, part of the solvent flowing over the orifice 9 is drawn through the orifice 9 in the reverse of the direction of ink flow during printing. The solvent is then drawn into main conduit 8 and vacuum conduit 33, and finally returned to the ink reservoir 40. This portion of solvent flow effectively cleans the interior of the orifice 9 as well as adjacent parts of the main conduit 8. The remainder of the solvent on the front face 14 flows as described above into drain conduit 16. Pulsating flow may be used to aid in dissolving residue in the interior of orifice 9.

Figure 5A:
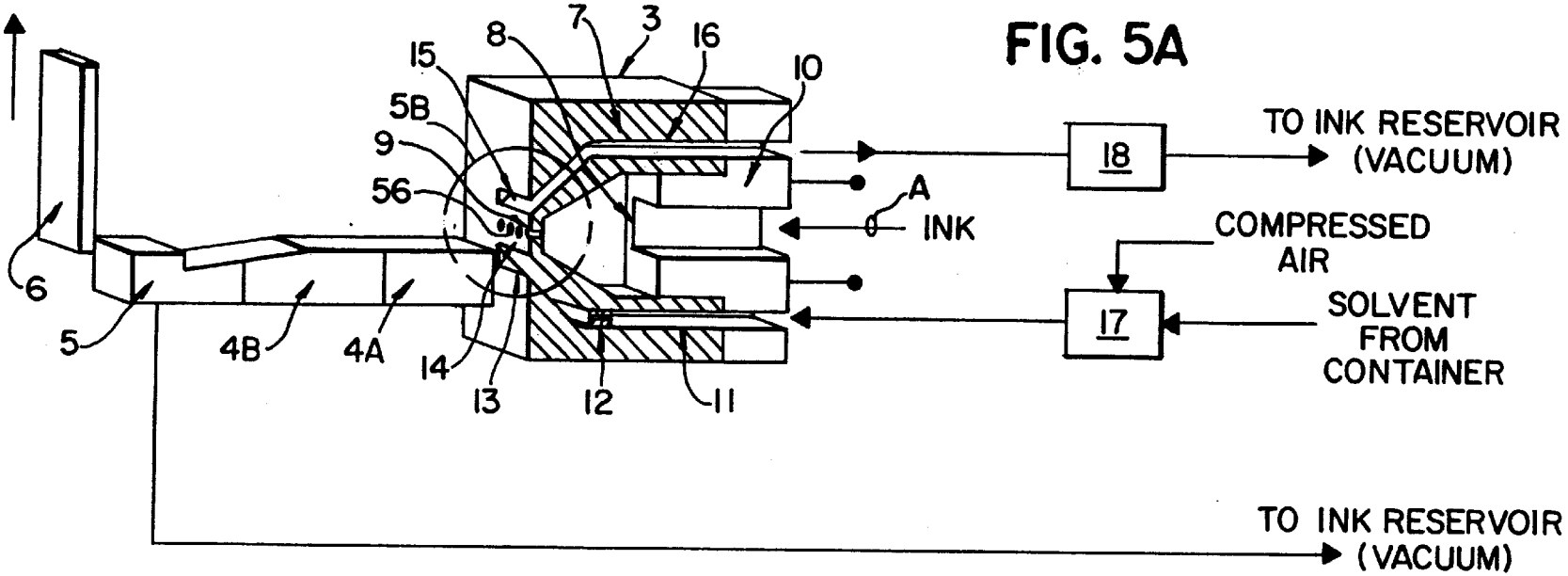
FIG. 5A is a simplified perspective view and diagram of the components of the ink jet printer of the present invention showing a multi-orifice array drop generator and the other components in cross section.
Figure 5B:
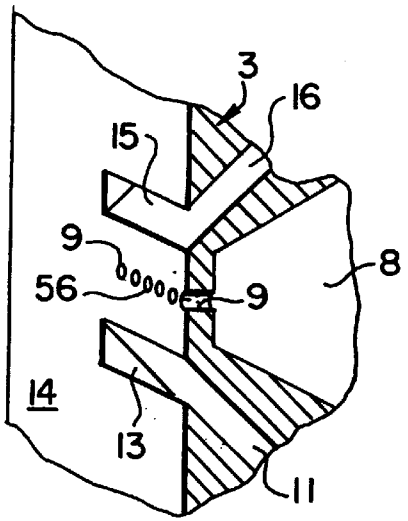
FIG. 5B is a partial close-up view of the drop generator of FIG. 5A.

Referring to FIGS. 5A and 5B, in another aspect of the present invention, the front face 14 of the drop generator 3 has an array 56 of orifices 9. The drain opening 15 and the supply opening 13 are shaped as slots so that solvent flowing from the supply opening 13 will flow over all of the orifices 9 and into the slotted drain opening 15. The flow restrictor 12 can also be shaped as a slot or as an array of holes aligned with the orifices 9.

Figure 6A:
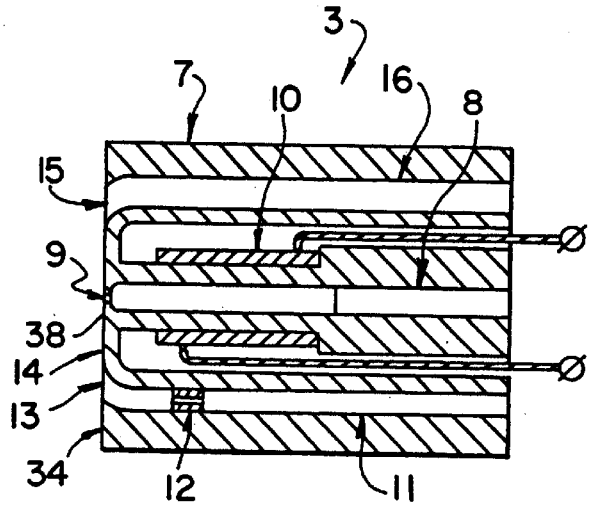
FIG. 6A is a simplified cross-sectional view of another alternative drop generator for the ink jet printer of the present invention.
Figure 6B:
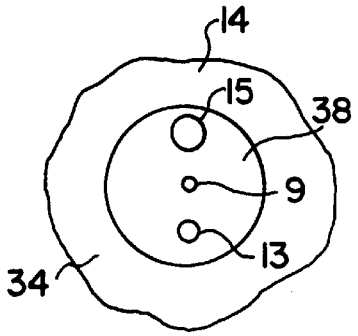
FIG. 6B is a simplified partial elevational view of the front face of the alternative drop generator for the ink jet printer of the present invention.

Referring to FIGS. 6A and 6B, in yet another aspect of the present invention, the front face 14 of the drop generator 3 has a non-solvent wettable material surface 34, such as TEFLON (polytetrafluoroethylene), on the exterior, peripheral surface portion of the front face 14 surrounding the orifice 9 and supply opening 13 and drain opening 15. A solvent-wettable, inner surface 38 for maintaining a thin film is preferably only placed within the peripheral surface 34. Some ink residue may be removed more effectively by a more viscous solvent, which forms a thicker solvent layer (not shown) on the front face 14. For this thicker solvent, increased suction in the conduit 16 may not be enough to prevent undesirable excessive wetting around the orifice or prevent dripping. Thus, front face 14 is provided with the non-solvent wettable surface 34 which prevents spread of the solvent in undesirable directions and prevents the solvent from dripping off the front face.

Figure 7:
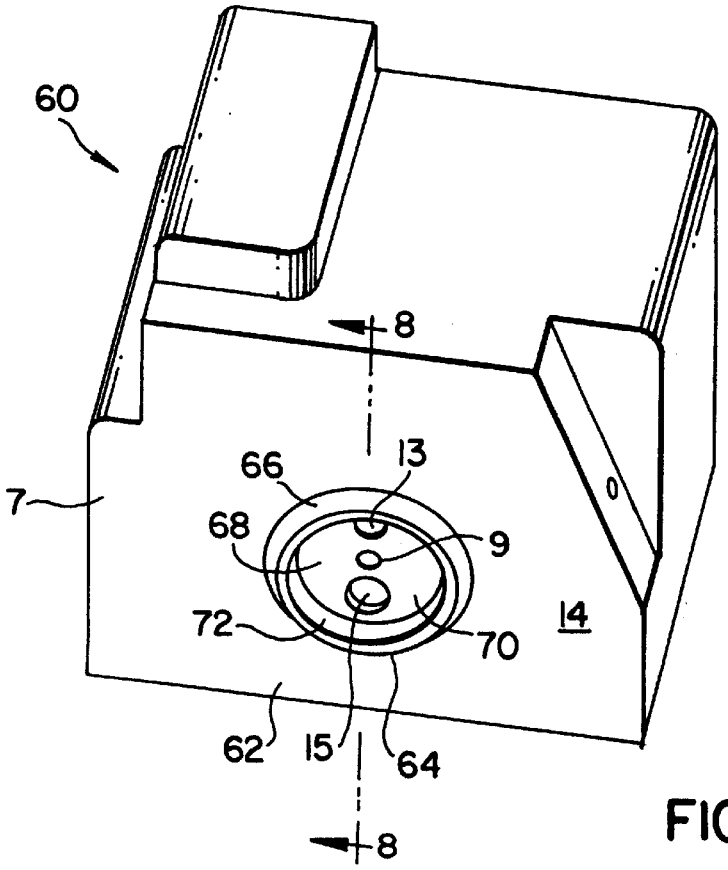
FIG. 7 is a simplified three-dimensional perspective view of another alternative drop generator for the ink jet printer of the present invention.

Referring now to FIGS. 7–8, an alternative drop generator is generally designated 60. The same numbers have been kept for referring to features similar to the features disclosed in FIGS. 1–6. The drop generator 60 has a body 7 with a front face 14. A generally planar surface 62 and well 64 are defined by the front face 14. A well 64 includes a generally annular peripheral sidewall 66 extending from the planar surface 62. While the sidewall 66 is preferably annular with approximately a height of 0.030", it will be appreciated that many other shapes and sizes for the sidewall 66 are possible.

An orifice 9 for emitting a stream of ink droplets, a supply opening 13 and a drain opening 15 are all preferably disposed within the well 64. The orifice 9 is preferably placed on a bottom 68 of the well 64 that defines a generally extending plane 70. The well has an internal diameter of approximately 0.180", although other sizes will be adequate. The sidewall 66 is high enough to trap or maintain solvent and residue that immediately escapes the suction from drain opening 15 and is flowing along the front face 14 within the well 64. In this case, the drain conduit 16 (shown in FIG. 8) provides sufficient negative pressure to drain solvent from anywhere within the well 64 within a few seconds. This occurs regardless of the orientation of the print head 2.

The sidewall 66 preferably includes an interior surface 72 that is inclined relative to the plane 70 of the bottom 68 of the well 64. The inclined interior surface 72 helps to maintain a thin film and prevents beading of the solvent. Also, in one preferred embodiment, the bottom of the well 64 is solvent-wettable.

Referring now to FIG. 9, in another embodiment, a drop generator 61 has a well 76, instead of the well 64. Well 76 is provided as an indentation or depression in a planar surface 86 of a bulging portion 84 placed on the front face 14. A bottom 80 of the well 76 is the bottom of the indentation and is preferably co-planar with the front face 14 although other depths for the well are possible. A sidewall 82 extends from the planar surface 86 of the bulging portion 84 to the bottom 80 of the well 76 and inwardly relative to the bulging portion 84. In this embodiment, the supply opening 13 for the solvent supply conduit 11 and the drain opening 15 for the drain conduit 16 are both disposed along the sidewall 82, although the openings could be placed in other positions. In the preferred embodiment, a bulging portion 84 is provided to accommodate the depth of the well 76. It will be appreciated that the bulging portion 84 can be integrally formed with the body 7 or it can be a separate piece that could be detachable. Further, the portion 84 may simply be a cover or a solid piece. Either way, the bulging portion 84 preferably provides the sidewall 82 for the well 76. It will also be appreciated that the openings 13 and 15 could be placed anywhere in or near the well 76 as long as solvent is delivered to the area near orifice 9 and suction from drain opening 15 adequately removes the solvent from the well 76.

The many advantages of this invention are now apparent. A supply opening 13 and a drain opening 15 are positioned by an orifice 9 on a front face 14 of a drop generator 3 so that solvent placed on the front face is drawn into the drain conduit 16 no matter the orientation of the print head 2. To further ensure that solvent placed on the front face 14 is drawn into the drain conduit 16 and does not drip off of the print head 2, the solvent supply conduit 11 has a flow restrictor (12 or 30) for forming a thin film of solvent, and the front face 14 is made from a solvent-wettable material. The front face 14 may also have a well 64 or 76 with sidewalls 66 or 82 to trap the solvent, and the drain conduit 16 and the supply conduit 11 may be angled toward each other. For further cleaning of the interior of the orifice 9, a vacuum conduit 33 is provided for drawing solvent from the front face 14 and into orifice 9 in the reverse of the direction ink travels through orifice 9 for printing.

While various embodiments of the present invention have been described, it should be understood that other modifications, substitutions and alternatives may be apparent to one of ordinary skill in the art. Such modifications, substitutions and alternatives can be made without departing from the spirit and scope of the invention, which should be determined from the appended claims.

What is claimed is:

1. A self-cleaning print head for an ink jet printer which directs ink to a substrate to be marked, the print head comprising:

a drop generator having a body with a front face, an ink supply conduit and at least one orifice extending through said front face, said orifice defining a nozzle for ejecting the ink;

a solvent supply conduit connected to a source of solvent for supplying solvent to said front face of said drop generator, wherein a flow of solvent from the source of solvent to said front face of said drop generator is restricted by a structure of said conduit so as to flow said solvent as a thin film on said front face of said drop generator;

a drain conduit for suctioning said solvent from said front face and into said drain conduit, said solvent supply conduit and said drain conduit having openings on said front face disposed, relative to each other and said orifice(s), so that said solvent released from said solvent supply conduit moves along said front face, adjacent said orifice(s) and into said drain conduit regardless of the spatial orientation of the print head.

2. The print head of claim 1, wherein said front face further defines a generally planar surface and a well having a generally continuous peripheral sidewall extending from said planar surface of said front face, and wherein said orifice, said supply opening and said drain opening are disposed within said well, wherein said sidewall maintains said solvent within said well.

3. The print head of claim 2, wherein said drain conduit is maintained under negative pressure to drain solvent from anywhere within said well.

4. The print head of claim 1, further comprising a bulging portion disposed on said front face, said bulging portion having a generally planar surface and an indentation defining a well with a bottom and a peripheral sidewall, said bottom of said well being defined by a bottom of said indentation, and wherein said sidewall extends from said planar surface of said bulging portion to said bottom of said well and inwardly relative to said bulging portion.

5. The print head of claim 1, wherein at least a portion of said front face has a non-solvent wettable material for retarding the flow of solvent to reduce dripping.

6. The print head of claim 5, wherein said material is selected from the group consisting of polytetrafluoroethylene (TEFLON).

7. The print head of claim 1, wherein the respective openings of said drain conduit and said solvent supply conduit are angled toward each other.

8. The print head of claim 1, wherein said structure of said conduit further includes a flow restrictor for restricting the flow of the solvent to flow it as said thin film on said front face rather than in beads or drops.

9. The print head of claim 1, wherein said body further includes an orifice unclogging mechanism that causes solvent disposed on said front face to flow into said orifice in the reverse of the direction ink flows through said orifice for printing.

10. The print head of claim 9, wherein said orifice unclogging mechanism includes a vacuum conduit connected to said ink supply conduit so that negative pressure may be applied to suction solvent from said front face through said orifice and into said vacuum conduit.

11. The print head of claim 1, wherein said drop generator includes an array of orifices, and wherein said drain and supply openings are slits disposed to flow solvent over all said orifices in said array.

12. A self-cleaning print head for an ink jet printer which directs ink to a substrate to be marked, the print head comprising:

a drop generator having a body with a front face and at least one orifice extending through said front face, said orifice defining a nozzle for ejecting the ink;

a main conduit for supplying ink to said orifice;

a solvent supply conduit connected to a source of solvent for conveying said solvent through a supply opening and onto said front face of said drop generator;

an orifice unclogging mechanism that causes said solvent disposed on said front face to flow into said orifice in the reverse of the direction ink flows through said orifice for printing.

13. The print head of claim 12, wherein said orifice unclogging mechanism further includes a vacuum conduit connected to said main conduit so that negative pressure may be applied to suction solvent from said front face, through said orifice and into said vacuum conduit.

14. The print head of claim 12, wherein the print head further includes a drain conduit with a drain opening in said front face for suctioning said solvent from said front face, said supply opening and said drain opening on said front face are configured and disposed, relative to each other and said orifice(s), so that said solvent released from said supply opening moves along said front face, adjacent said orifice(s) and into said drain opening and drain conduit regardless of the spatial orientation of the print head.

15. A method of cleaning an ink jet printer print head, comprising the steps of:

flowing solvent through a solvent supply conduit to a front face of the print head, said front face having a generally planar surface and at least one orifice extending through said front face, said orifice defining a nozzle for ejecting the ink therefrom, wherein the flow of said solvent through said solvent supply conduit to said front face of the print head is restricted by a structure of said conduit so as to flow said solvent as a thin film on said front face of the print head; and using suction to cause said solvent to move along said front face adjacent said orifice and into a drain conduit to remove said solvent from said front face regardless of the spatial orientation of the print head.

16. The method of cleaning a print head according to claim 15, wherein the step of flowing solvent further includes flowing said solvent within a well defined by said front face, said well having a generally continuous peripheral sidewall extending from said planar surface of said front face, said orifice being disposed at a bottom of said well, and said supply opening and said drain opening being disposed within said well, wherein said step of flowing solvent includes maintaining said solvent within said well by said sidewall.

17. The method of cleaning a print head according to claim 15, wherein the step of flowing solvent further includes flowing said solvent within a well defined by a bulging portion on said front face, said bulging portion having a planar surface, said well having a generally continuous peripheral sidewall extending from said planar surface of said bulging portion, said orifice being disposed at a bottom of said well, and said supply opening and said drain opening being disposed within said well, wherein said step of flowing solvent includes maintaining said solvent within said well by said sidewall.

18. The method of cleaning a print head according to claim 15, wherein said step of flowing solvent further includes flowing said solvent over a solvent-wettable portion of said front face located adjacent to said orifice and within a non-solvent wettable portion of said front face that completely surrounds said solvent-wettable portion, thus maintaining said solvent within the solvent-wettable portion and preventing it from dripping off of said front face.

19. The method of cleaning a print head according to claim 15, further including the step of:

flowing said solvent disposed on said front face into said orifice in the reverse of the direction ink flows through said orifice for printing.

20. A self-cleaning print head for an ink jet printer which directs ink to a substrate to be marked, the print head comprising:

a drop generator having a body with a front face, an ink supply conduit and at least one orifice extending through said front face, said orifice defining a nozzle for ejecting the ink;

a solvent supply conduit for supplying solvent to said front face of said drop generator;

a drain conduit for suctioning said solvent from said front face and into said drain conduit, said solvent supply conduit and said drain conduit having openings on said front face disposed, relative to each other and said orifice(s), so that said solvent released from said solvent supply conduit moves along said front face, adjacent said orifice(s) and into said drain conduit; and a bulging portion disposed on said front face, said bulging portion having a generally planar surface and an indentation defining a well with a bottom and a peripheral sidewall, said bottom of said well being defined by a bottom of said indentation, and wherein said sidewall extends from said planar surface of said bulging portion to said bottom of said well and inwardly relative to said bulging portion.

21. A method of cleaning an ink jet printer print head, comprising the steps of:

flowing solvent through a solvent supply conduit to a front face of the print head, said front face having a generally planar surface and at least one orifice extending through said front face, said orifice defining a nozzle for ejecting the ink therefrom;

using suction to cause said solvent to move along said front face adjacent said orifice and into a drain conduit to remove said solvent from said front face; and said step of flowing solvent further including flowing said solvent within a well defined by a bulging portion on said front face, said bulging portion having a planar surface, said well having a generally continuous peripheral sidewall extending from said planar surface of said bulging portion, said orifice being disposed at a bottom of said well, and said supply opening and said drain opening being disposed within said well, wherein said step of flowing solvent includes maintaining said solvent within said well by said sidewall.

* * * * *